United States Patent [19]

Maurer

[11] 4,321,973

[45] Mar. 30, 1982

[54] ROTARY IMPACT CLUTCH

[76] Inventor: Spencer B. Maurer, 6070 Tarawood Dr., Orlando, Fla. 32811

[21] Appl. No.: 65,519

[22] Filed: Aug. 10, 1979

[51] Int. Cl.[3] ..... B25D 15/02

[52] U.S. Cl. ..... 173/93.5

[58] Field of Search ..... 173/93.5, 93, 93.6, 173/94, 93.7; 81/52.3, 466

[56] References Cited

U.S. PATENT DOCUMENTS

| | | | |
|---|---|---|---|
| 2,842,994 | 7/1958 | Stine | 173/93.5 |
| 2,940,566 | 6/1960 | Conover, Jr. | 173/93.5 |
| 3,072,232 | 1/1963 | Martin et al. | 173/93.5 |
| 3,210,960 | 10/1965 | Vaughn | 173/93 X |
| 3,362,486 | 1/1968 | Alajouanine | 173/93.5 |
| 3,480,092 | 11/1969 | Reinold | 173/93 X |
| 3,561,543 | 2/1971 | Ulbing | 173/93.5 |

*Primary Examiner*—Werner H. Schroeder
*Assistant Examiner*—Andrew M. Falik
*Attorney, Agent, or Firm*—Eber J. Hyde

[57] ABSTRACT

This invention pertains to an impact wrench mechanism and a clutch therefor, wherein a motor having an output shaft rotatably drives a carrier member mounted on an axis. Anvil jaw(s) rotatably and coaxially mounted adjacent the carrier member have impact jaw(s) extending radially therefrom. Hammer member(s) having impact jaw(s) for impacting with the anvil jaw(s) is (are) mounted on the carrier member for rotation therewith and for limited linear motion relative thereto in a direction essentially transverse to the axis of rotation to allow the hammer member impact jaw(s) to contact the anvil jaw(s). The line of force of the impact blow has a force component tending to urge the hammer member(s) out of engagement with the anvil jaw(s), but the hammer member(s) have a mass and a mass center location such that linear inertial force is created which prevents motion of the hammer member(s) during the impact blow.

10 Claims, 12 Drawing Figures

ROTARY IMPACT CLUTCH

The present invention relates closely to the invention disclosed and claimed in U.S. patent application Ser. No. 277,788, filed Aug. 3, 1972, which application was abandoned. This present application comprises a refinement and improvement of the invention of Ser. No. 277,788, in that an essentially balanced, double hammer mechanism is utilized which reduces vibration, and while it entails more parts, the parts are easier to make and are less expensive.

An object of the present invention is to provide a balanced impact wrench mechanism having a minimum number of moving parts which can be made relatively inexpensively, and which have low internal friction due to the use of low-friction rollers.

A further object of the invention is to provide a low-cost, durable impact wrench with high torque output, and which has high strength parts which are few in number and are inexpensive to make.

Another object of the invention is to provide an impact mechanism which applies to its output shaft substantially simultaneously, two essentially equal blows spaced 180 degrees about its shaft to reduce vibration.

A further object of the invention is to reduce cost by utilizing more, yet simpler, parts.

An aspect of the present invention lies in the provision of an impact wrench, preferably driven by compressed air, wherein one or more carrier member means is mounted on an axis of rotation and is adapted to be rotatably driven. One or more anvil means is rotatably and coaxially mounted adjacent the carrier member means, and the means has generally radially projecting jaw means with impact surface means. One or two hammer member means which include impact jaw means adapted to impact with the anvil jaw means, is (or are) mounted on the carrier member means for rotation therewith and for limited linear motion relative thereto in a direction essentially transverse to the axis of rotation to allow the hammer member impact jaw means to contact said anvil impact jaw surface means to deliver an impact blow thereto. The line of force of the one or more impact blows has a component tending to force the hammer jaw means out of engagement with the anvil jaws means, but the hammer means has a mass and a mass center location such that inertial force is created by deceleration which prevents the linear motion of the hammer member means relative to the carrier member means during the impact blow. Prior to the impact blow the same inertial force has an opposite effect during acceleration and tends to cause motion of the hammer impact jaw means to a disengaged position; however, a component of the centrifugal force, acting on the hammer mass, through its mass center, is sufficient to prevent this motion of the hammer means to the disengaged position after it has been positioned to strike an impact blow.

For a better understanding of the present invention, together with other and further objects thereof, reference is had to the following description taken in conjunction with the accompanying drawings, and its scope will be pointed out in the appended claims. With reference to the drawings: FIGS. 1 through 7 relate to an impact mechanism which strikes a succession of individual blows, whereas FIGS. 8 through 12 relate to an impact mechanism which strikes a succession of double blows.

FIG. 3 shows the relationship at the instant of "impact" in the clockwise direction;

FIG. 4 shows the "disengaged" position approximately 5° later;

FIG. 5 shows the relationship at the start of the camming action, about 128° from "impact";

FIG. 6 shows their positions at the end of "cam", about 150° from "impact";

FIG. 7 shows the relationship while the centrifugal detent action is in effect;

Figure 1:
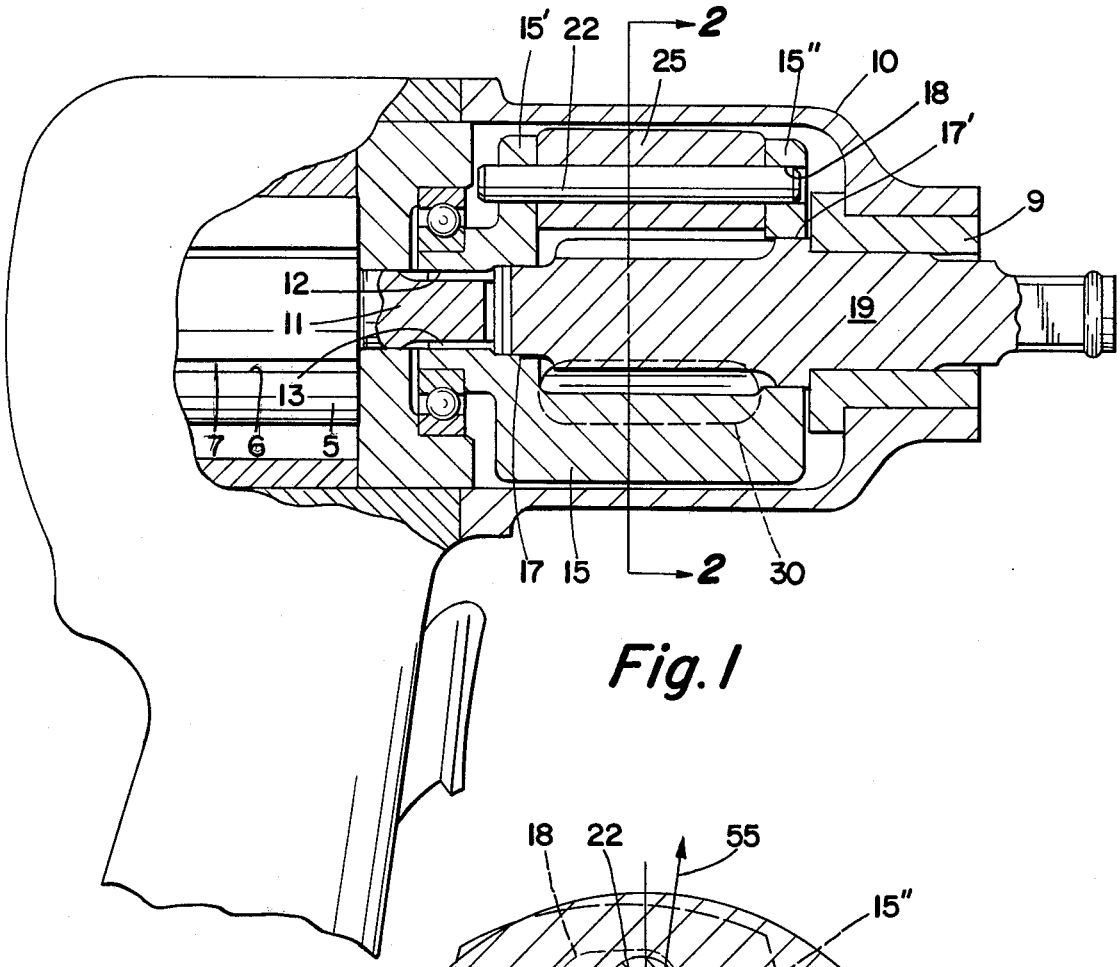
FIG. 1 is a sectional side view of the impact wrench of this invention, especially showing the clutch portion thereof.

With reference to FIG. 1, reference character 10 identifies the housing for an air driven impact wrench; the air motor is well known in the art, and need not be described in detail. However, it is comprised of a massive slotted rotor 5 with a vane 7 slidably mounted in each of a plurality of slots 6.

The output shaft 11 of the air driven rotor 5 has splines 12 at its outer end and is coupled through meshing splines 13 to a carrier member 15 which is journaled at 17 and at 17' on the tool power output shaft 19.

The motor shaft 11 is coaxially aligned with the power output shaft 19 and the carrier member 15 is coaxially mounted around the output shaft 19, and is mounted for rotation in respect to the output shaft 19. The carrier member 15 comprises two spaced end sections 15' and 15'' connected together by the main, lower portion 15. The rear end portion of the output shaft 19 is integrally formed with an anvil 23 extending generally radially therefrom and providing a forward impact receiving surface 20, and a reverse impact receiving surface 21. The forward end of the output shaft 19 is carried by a bushing 9 mounted in the forward end of the tool housing 10. Extending between the two spaced apart end portions 15' and 15'' of the carrier member 15 is a retaining pin 22 which extends through slots 18 in each of the end sections 15' and 15'', shown in dotted lines in FIG. 2. Mounted around the pin 22 for limited linear motion in respect to the carrier member 15 is a hammer member 25. Pin 22 can slide a limited distance in slots 18 in a direction essentially transverse to the axis of rotation of the tool, thereby permitting the hammer member 25 to move linearly in respect to the output shaft 19, the anvil 23 and the carrier member 15. The amount of motion is sufficient to permit the hammer member and the anvil to clear during acceleration of the tool, as will later be more fully explained.

Figure 2:
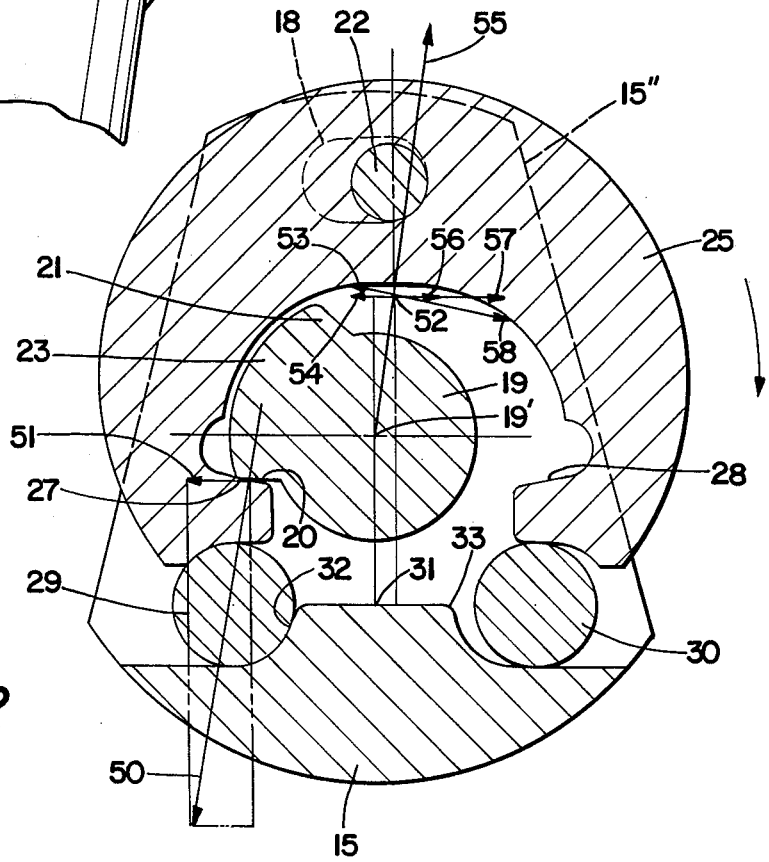
FIG. 2 is a sectional view taken along line 2—2 of FIG. 1, particularly showing the relationship of the carrier member, the hammer member and the anvil, which comprise the three main parts of the clutch.

As shown best in FIG. 2, the hammer member 25 is an essentially "U" shaped member with the pin 22 through its closed end and with its open end on the other side of drive shaft 19 from the pin 22. At its open end the hammer member 25 carries a pair of inwardly projecting impact jaws 27 and 28, jaw 27 being the forward jaw and 28 the reverse jaw. Between the carrier member 15 and the hammer member 25 and in contact with both members are located two rollers 29 and 30. The purpose of the rollers is to reduce frictional forces as the hammer member 25 moves linearly relative to the rotary axis of the tool. A raised portion 31 of the carrier member 15 includes milled arcuate surfaces 32,33 which form limit stops for the rollers 29,30.

Figure 3:
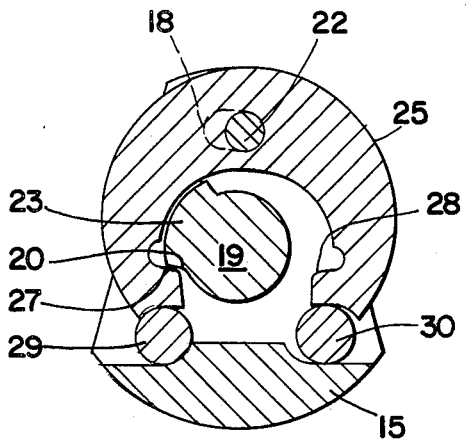
FIGS. 3 to 7 are sectional views, similar to FIG. 2, showing the relationship of the three major clutch parts at successive points during a clockwise cycle of the tool.

The operation of the tool is explained starting from the moment of impact, as shown in FIGS. 2 and 3, with the forward impact jaw 27 of the hammer member 25 in a hammer blow engagement with the forward anvil surface 20 of the output shaft 19.

Figure 4:
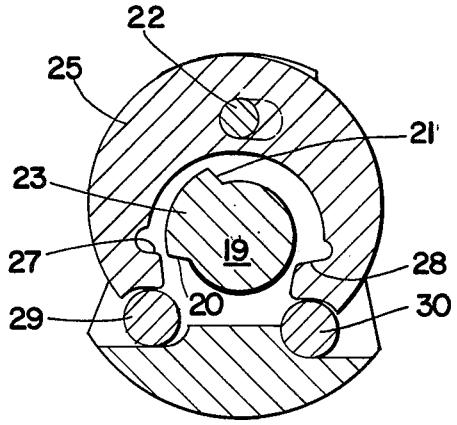
Figure 5:
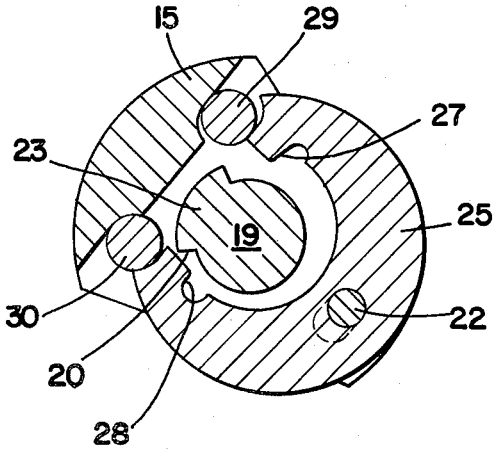
Figure 6:
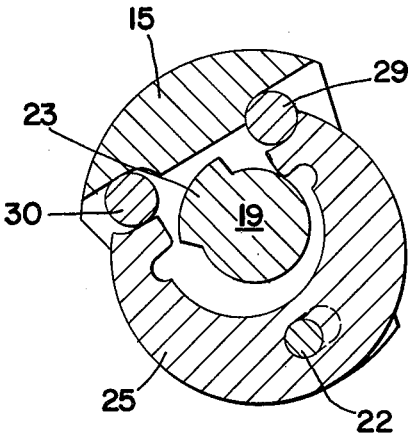
Figure 7:
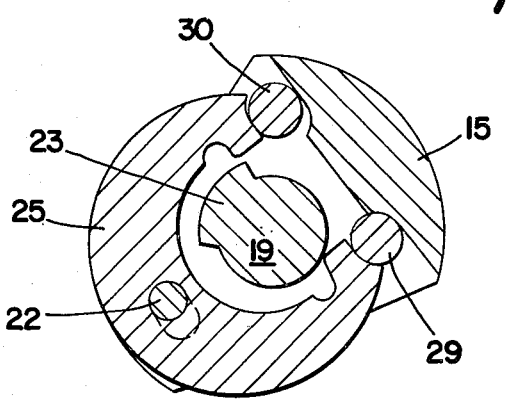

The motor output shaft 11 is directly driving carrier member 15 in a clockwise direction, as shown by the arrow in FIG. 2. Immediately following the impact blow, shown in FIG. 3, the hammer member 25 rolls laterally to the left on the rollers 29,30, with the pin 22 sliding in slots 18 in the end sections 15' and 15'' of the carrier member, to the disengaged position shown in FIG. 4. At this point the motor is still driving the carrier member 15, the pin 22, the hammer member 25 and the rollers 29,30 in a forward clockwise direction relative to the output shaft 19 and anvil face 20. Clearance between the hammer jaw 27 and anvil jaw 20 permits rotation of the carrier member and hammer member, as a unit, past the anvil jaw 23 to the position shown in FIG. 5 where a cam action starts by the engagement of the motor driven hammer member 25 against the relatively stationary lug 23. This causes the hammer member 25 to roll on the rollers 29,30 from the position shown in FIG. 5 to that shown in FIG. 6, which is the end of the cam movement. A centrifugal detent action, explained more fully later, holds the rotating parts in the position shown in FIGS. 6 and 7 as the tool picks up additional speed and energy from the motor prior to the next impact blow, shown in FIG. 3. This centrifugal detent action is effective at least by the time the parts reach the position shown in FIG. 7. During the impact blow the inertia of the rotating hammer member acts to prevent disengagement of the hammer until the momentum of the carrier member and the hammer member has been expended through the output shaft.

An advantage of this tool lies in the fact that the total kinetic energy of the motor rotor 5 from the motor shaft 11, the carrier member 15 and the hammer 25 is used in each impact, since there can be no disengaging action until the momentum of the hammer member has been dissipated. There is a further advantage of low internal friction due to the rollers 29,30 located between the carrier member and the hammer. When a nut is loose the tool acts to run it down without impacting until sufficient resistance is encountered, at which point the tool automatically commences to impact. During rundown the clutch parts are in the position shown in FIG. 2, and due to centrifugal force and friction between the hammer and anvil jaws good rundown torque is obtained from the motor, directly through the carrier member to the hammer member and thence directly to the anvil and output shaft 19.

During reverse action of the tool the hammer member 25 is in impacting position, similar to FIG. 2, but with the reverse impact jaw against the reverse anvil surface 21. The impact and clutch action is similar to the forward action.

With reference to FIG. 2, there are illustrated certain relationships essential to best operation of the tool. When the hammer jaw 27 strikes an impact blow to the anvil jaw 20 a force is created. The arrow-headed line 50 illustrates the direction of the impact force line and is indicative of its magnitude. It is in a direction approximately 9° from the vertical, as shown, and it has a horizontal component arrow-headed line 51, which represents the declutching component of the impact force.

Reference character 52 locates the center of gravity of the hammer member 25. In FIG. 2 it is located above and slightly to the right of the axis 19' of output shaft 19, since the hammer member is shown as far to the right as it can go.

Line 53 illustrates the hammer member mass force during acceleration and just prior to impact, while line 54 indicates the declutching component of force 53.

Line 55 represents the centrifugal force of the hammer mass during acceleration of the hammer, and line 56 represents the clutching component of force 55.

The force represented by line 56 is greater than the force represented by line 54 by the time the cam action is completed, which provides a centrifugal detent action that holds the hammer member 25 in the engaged position, preparatory to striking the next impact blow.

During the deceleration of the impact blow the inertial force of the hammer member 25 is in the direction shown by force line 58, which has a component as shown by force line 57 which opposes and overcomes the declutching component 51, of the hammer impact force 50 on jaw 27.

When the inertial forces have been completely dissipated and the hammer jaw 27 is still in contact with anvil jaw 20, as would be the case when the resistance torque of the work being driven is quite low, the drive torque of the motor creates a force similar to impact force 50 which has a component similar to impact force component 51 which is sufficient to overcome the frictional resistance at the impact jaws 20, 27 and cause the hammer member 25 to roll on rollers 29,30 relative to the carrier member 15 to the disengaged position. On the other hand, when the resistance torque of the work is higher and rebound occurs after the impact blow, the motor is driven backwards and an inertia force similar to 53 is created which has a component similar to component 54, which causes the hammer 25 to move to the disengaged position since there is little or no centrifugal force present.

Figure 8:
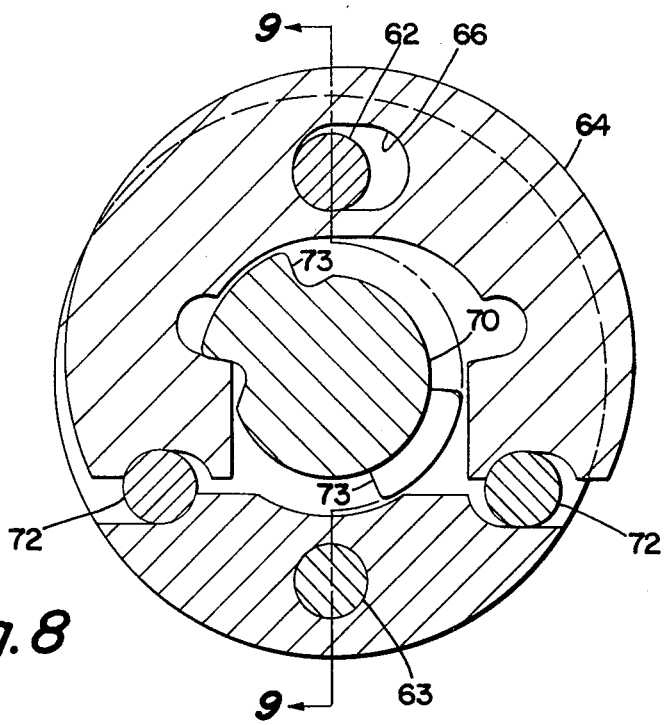
FIG. 8 is a sectional view similar to FIG. 2 but showing one hammer of a double-hammer impact mechanism taken along line 8—8 of FIG. 9.
Figure 9:
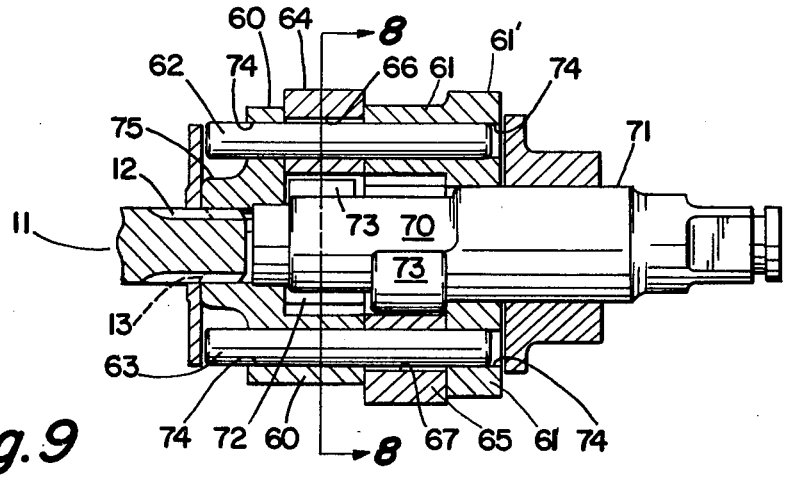
FIG. 9 is a sectional view taken along line 9—9 of FIG. 8 (but with portions of the housing in place)
Figure 11:
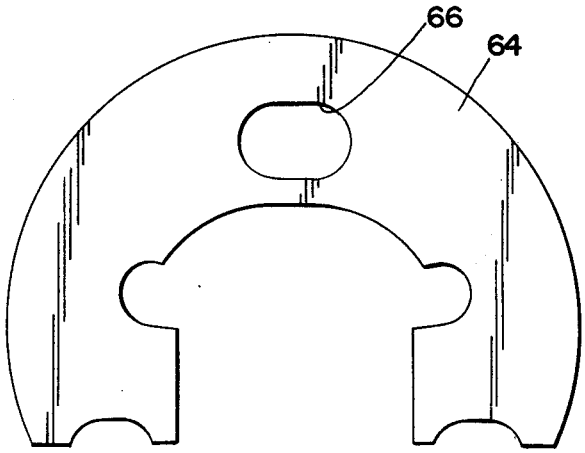
FIG. 11 is a face view of one of the two identical hammer members.
Figure 10:
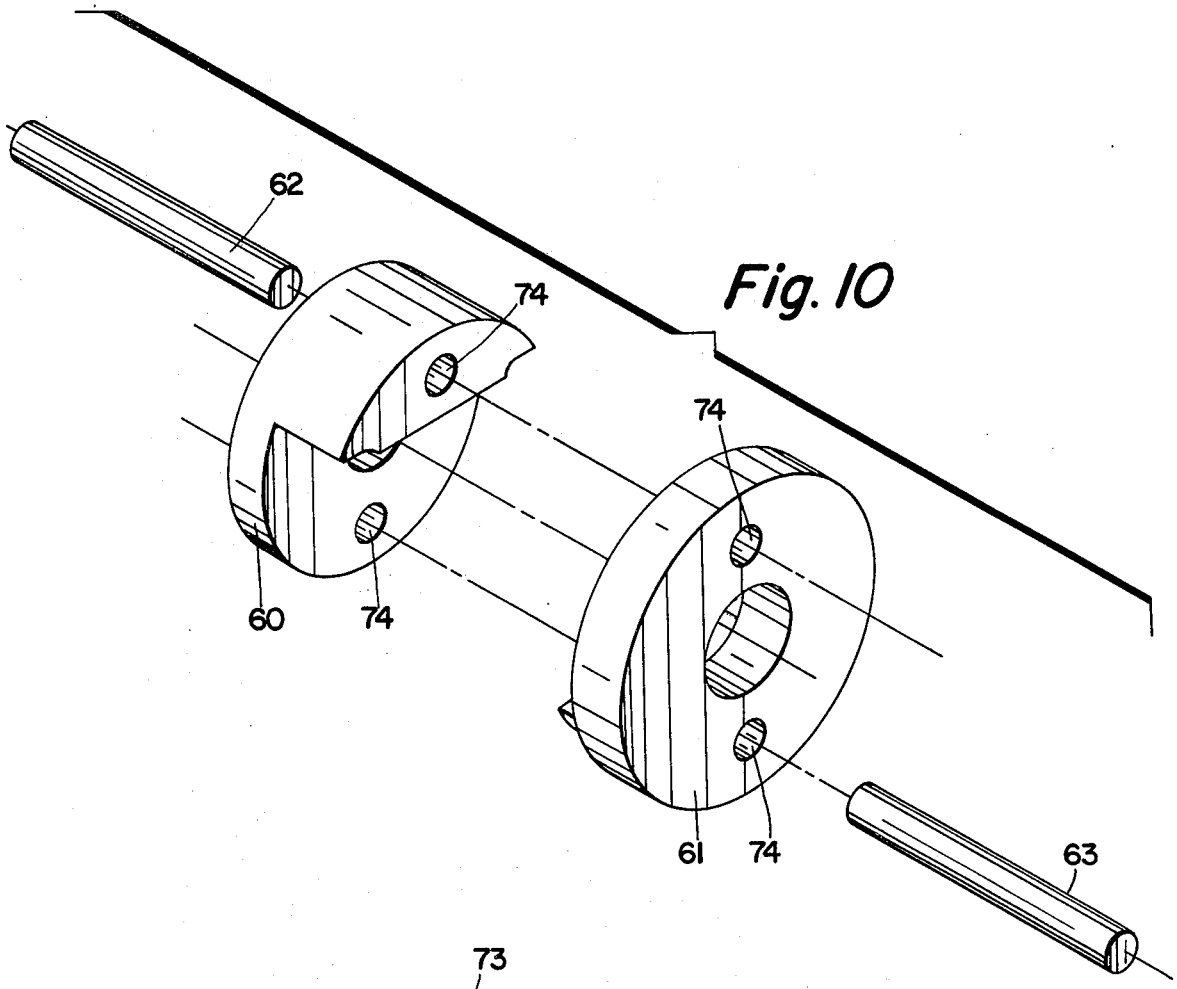
FIG. 10 is an isometric view of the rear frame and the front frame portions interconnected by pins to form the carrier member.

With reference to FIGS. 8 through 12 there is shown an impact wrench mechanism wherein the carrier member means is comprised of a rear frame 60 and a separate front frame 61 connected by two pins 62 and 63 to rotate in unison. Two identical hammer means 64,65 are mounted between the rear 60 and front 61 frames with the pins 62 and 63 extending, respectively, through slots 66 and 67. As shown in FIG. 8 and FIG. 11 each hammer is horseshoe shaped whereby only one pin slot (66 or 67) is required in each hammer, the open end of each horseshoe shaped hammer providing space for the other pin. As shown in FIG. 9 the two hammers are mounted around an anvil shaft member 70 which is integral with an output shaft 71, and the hammers are disposed 180° from each other around the anvil and are spaced axially.

Figure 12:
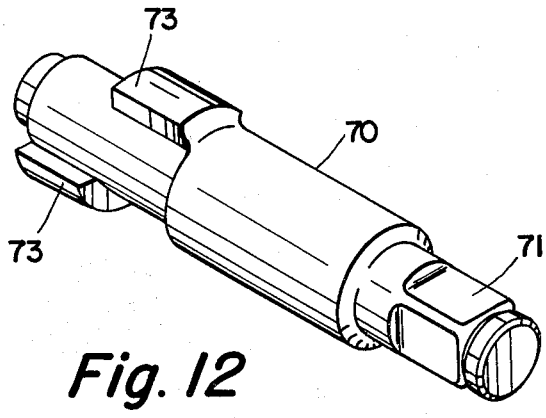
FIG. 12 is an isometric view of the anvil means and output shaft.

As shown in FIG. 12 the anvil shaft member 70 has two integral projections 73 located 180° from each other for receiving blows from the two hammer members 64,65, and they also are spaced axially. As shown, the hammer members 64,65 are face-to-face though they may be spaced further apart axially along anvil shaft member 70 with an additional portion of the carrier member (not shown) mounted in between the hammers and on the pins 62,63.

The rear frame 60 includes a hub portion 75, the interior of which has a splined portion 13 in engagement with splines 12 on the motor shaft 11. Pins 62 and 63 extend through round holes 74 in the rear and front frames 60,61 and thus couple the two frames together to form the carrier member means which rotates as a single unit, and the slots 66 and 67 in the hammer members 64,65 permit the hammer members to roll on rollers 72 in respect to the rotary axis of the clutch, as described in connection with the single hammer clutch.

The operation of the clutch is similar to the operation of the single hammer clutch shown in FIGS. 1 to 7 but with the advantage that the double hammer clutch strikes two blows, substantially simultaneously and 180° spaced around the output shaft 71. This reduces vibration in the tool, and while more parts are involved, the split carrier member means 60,61,62,63 is much less expensive to make than the single piece carrier member 15,15' of FIGS. 1 and 2.

The two-piece end frames 60,61 of the carrier member means provide for an important inertia balance relationship in the clutch. The inertia of the front frame 61 should be substantially equal to the inertia of the rear frame 60 plus the inertia of the rotor 5. To effect this relationship the front frame 61 has increased diameter at 61'. Alternately, the front frame 61 could be slightly longer than the rear frame member 60. This inertia balance relationship assures that the two hammers strike substantially equal blows.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. An impact wrench mechanism comprising:

carrier member means rotatably mounted on an axis of rotation and adapted to be driven;

centrally located anvil means rotatably and coaxially mounted within said carrier member means and having generally radially projecting jaw means with impact surface means;

hammer member means generally of an open-ended U-shape in cross-section transverse to said axis of rotation with legs on either side of said opening, jaw means connected to said legs and projecting inwardly at said opening and adapted to impact with said anvil jaw means, and said hammer member means being mounted on said carrier member means for rotation therewith and for limited linear motion relative thereto in a direction essentially transverse of said axis to allow said hammer member impact jaw means to contact said anvil impact surface means to deliver an impact blow thereto, the line of force of said impact blow having a component tending to force said hammer jaw means out of engagement with said anvil jaw means and said hammer means having a mass and a mass center location such that an inertia force is created which prevents linear motion of the hammer member means relative to said carrier member means during the impact blow.

2. An impact wrench mechanism as set forth in claim 1, further characterized by said hammer member means comprising two separate spaced apart hammer members each mounted on said carrier member means, the two hammer members being 180° around said anvil means for each other, and said anvil means having two impact jaws spaced apart along its axis and 180° apart around said anvil means.

3. An impact wrench mechanism as set forth in claim 2, further characterized by said two hammer members being mounted on said carrier member means in face-to-face contact with each other.

4. An impact wrench as set forth in claim 1, further characterized by said carrier member means comprising a rear frame member having two off-center holes through it and a separate front frame member having two off-center holes therethrough, and two pins extending through said holes in the said rear and front frame members to interconnect said frame members for rotation in unision about said axis of rotation.

5. An impact wrench as set forth in claim 4, further characterized by the inertia of said front frame member being substantially equal to the inertia of said rear frame member plus the inertia of said rotor.

6. An impact wrench mechanism as set forth in claim 1, further characterized by antifriction drive roller means located between said carrier member means and said hammer member means adapted to allow said relative transverse motion and to provide a torsional driving connection between said carrier member means and said hammer member means aproximately in the path of the impact blow force line.

7. An impact wrench mechanism as set forth in claim 1, further characterized by drive roller means located between said carrier member means and said hammer member means and in contact with each of said means, said carrier member means having stop faces at the location of said drive roller means against which said drive roller means engage.

8. An impact wrench mechanism as set forth in claim 1 further characterized by drive roller means located between said carrier member means and said hammer member means and in contact with each of said means, retaining pin means to connect said hammer member means to said carrier member means, said retaining pin means being located to the side of said hammer member means opposite said drive roller means.

9. An impact wrench mechanism comprising:

carrier member means rotatably mounted on an axis of rotation and adapted to be driven;

centrally located anvil means rotatably and coaxially mounted within said carrier member means and having generally radially projecting jaw means with an impact surface means;

hammer member means generally on an open-ended U-shape in cross-section transverse to said axis of rotation and including inwardly projecting impact jaw means mounted adjacent said anvil means on said carrier member means for rotation therewith and for limited linear engaging motion relative thereto in a direction generally trasverse to said axis of rotation to allow said hammer impact jaw means to contact said anvil jaw means and deliver a rotary impact blow thereto, the force-line of said impact blow having a component parallel to but opposite to said transverse linear engaging motion, and said hammer member means having a mass and a mass center location such that the inertia force of said hammer member means has a force component which counteracts said component of the impact force during the period of the impact blow and such that the centrifugal force acting on said hammer mass center tends to hold the hammer in said engaged position prior to said impact blow.

10. An impact wrench mechanism comprising:

carrier member means rotatably mounted on an axs of rotation and adated to be driven;

anvil means rotatably and coaxially mounted adjacent said carrier member means and having radially outward projecting impact jaw means with clockwise and counterclockwise impact surface means;

hammer member means generally of an open-ended U-shape in cross-section transverse to said axis of rotation and including a pair of inwardly projecting impact jaw means at the open end thereof and mounted adjacent said anvil means on said carrier member means for rotation therewith and for limited linear motion relative thereto to allow said hammer jaw means to move into and out of the path of rotation of said anvil jaw means to deliver a series of impact blows thereto, the mass center of said hammer member means being positioned on the vertical center line of said "U" shaped hammer member means as far away from said hammer jaw means as possible.

* * * * *